US007508137B2

(12) United States Patent
Choo

(10) Patent No.: US 7,508,137 B2
(45) Date of Patent: Mar. 24, 2009

(54) PLASMA DISPLAY PANEL AND METHOD OF MANUFACTURING THE SAME

(75) Inventor: Seong-Hun Choo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 491 days.

(21) Appl. No.: 11/320,747

(22) Filed: Dec. 30, 2005

(65) Prior Publication Data

US 2006/0226778 A1 Oct. 12, 2006

(30) Foreign Application Priority Data

Apr. 8, 2005 (KR) ..... 10-2005-0029537

(51) Int. Cl.
*H01J 17/49* (2006.01)

(52) U.S. Cl. ..... 313/582; 445/24; 313/585

(58) Field of Classification Search ..... 313/582–587; 345/37, 41, 60, 71

See application file for complete search history.

(56) References Cited

U.S. PATENT DOCUMENTS

| | | | |
|---|---|---|---|
| 7,208,875 | B2 | 4/2007 | Kwon et al. |
| 7,208,876 | B2 | 4/2007 | Kang et al. |
| 7,315,122 | B2 | 1/2008 | Kwon et al. |
| 7,323,818 | B2 | 1/2008 | Kwon et al. |
| 2004/0256989 | A1 | 12/2004 | Kim et al. |
| 2004/0263078 | A1 | 12/2004 | Woo et al. |
| 2005/0001551 | A1 | 1/2005 | Kim et al. |
| 2005/0029939 | A1 | 2/2005 | Woo et al. |
| 2005/0052359 | A1 | 3/2005 | Kwon et al. |
| 2007/0200502 | A1 | 8/2007 | Kang et al. |

FOREIGN PATENT DOCUMENTS

| | | | |
|---|---|---|---|
| KR | 10-2004-0058632 | A | 7/2004 |
| KR | 10-2005-0000899 | A | 1/2005 |
| KR | 10-2005-0004612 | A | 1/2005 |
| KR | 10-2005-0007642 | A | 1/2005 |
| KR | 10-2005-0007643 | A | 1/2005 |
| KR | 10-2005-0010135 | A | 1/2005 |
| KR | 10-2005-0011273 | A | 1/2005 |
| KR | 10-2005-0011935 | | 1/2005 |
| KR | 10-2005-0015008 | A | 2/2005 |

*Primary Examiner*—Mariceli Santiago
*Assistant Examiner*—Donald L Raleigh
(74) *Attorney, Agent, or Firm*—Lee & Morse, P.C.

(57) ABSTRACT

A plasma display panel, and a method of manufacturing the same, including a substrate, barrier ribs formed on the substrate and defining discharge cells and non-discharge cells, the barrier ribs including first, second and third barrier rib members, wherein the discharge cells are defined by the first and second barrier rib members, the second barrier rib members perpendicular to and intersecting the first barrier rib members, the non-discharge cells are defined by the second and third barrier rib members, wherein the third barrier rib members are located between columns of the discharge cells and are disposed parallel to the first barrier rib members, and a cross-sectional area of at least one third barrier rib member is greater at a bottom portion of the at least one third barrier rib member than at a top portion thereof.

20 Claims, 4 Drawing Sheets

PLASMA DISPLAY PANEL AND METHOD OF MANUFACTURING THE SAME

BACKGROUND OF THE INVENTION

1. Field of the Invention

The present invention relates to a plasma display panel and a method of manufacturing the same. In particular, the present invention relates to a plasma display panel having a modified structure of barrier ribs for applying a phosphor layer effectively, and a method of manufacturing the same.

2. Description of the Related Art

A plasma display panel (PDP) is typically a display device in which vacuum ultraviolet light from plasma generated by gas discharge excites phosphors to emit visible light for producing an image. The PDP has received much attention as a next generation thin display device due to various advantageous features, such as its suitability for large screen sizes and its high resolution. PDPs may be classified into direct current (DC), alternating current (AC) and hybrid types. Recently, a three-electrode type surface discharge AC PDP has been of particular interest.

On a rear substrate of the three-electrode type surface discharge AC PDP, address electrodes, barrier ribs and a phosphor layer are formed at positions corresponding to each discharge cell. Display electrodes consisting of scan electrodes and sustain electrodes are formed on a front substrate. The discharge cells are defined and divided by the barrier ribs and filled with a discharge gas.

A discharge cell for light emission is selected by a signal voltage applied between the address electrode and the scan electrode. A plasma discharge then takes place inside the selected discharge cell, induced by a voltage of about 150 to 200 V applied between the sustain electrode and the scan electrode. Vacuum ultraviolet light is emitted from exited Xe atoms in the selected discharge cell during the plasma discharge. The vacuum ultraviolet light excites the phosphor layer in the discharge cell to emit visible light for an image.

The PDP may include non-discharge areas formed among the discharge cells for improving luminous efficiency and bright room contrast of the PDP. Where the non-discharge area is fully opened in one direction, i.e., has a channel-like structure, discharge cell shrink may cause the barrier ribs to become distorted. In order to reduce the chances of distortion, bridge-type barrier rib members may be formed at intervals along the non-discharge area to support and reinforce the barrier ribs. These bridge-type barrier rib members may intersect the non-discharge areas so as to break up the channel-like structure of the non-discharge area into non-discharge cells.

In the manufacture of PDPs having the above-described structures, the phosphor layer has typically been formed by printing or coating the phosphor onto the substrate having the barrier ribs. However, printing the phosphor has generally resulted in higher cost due to the necessity of providing a screen mask for individual phosphor colors. The high cost of printing, combined with the lower throughput of the printing process, has made coating processes more attractive for high-volume mass production of PDPs.

In the coating process, each of the R (red), G (green), B (blue) phosphors may be separately applied, and may be applied continuously from a dispenser while passing the dispenser over the appropriate discharge cells. However, due to the continuous nature of the application, phosphor is also delivered to non-discharge areas that lie in the path of application. That is, the dispenser may not interrupt its delivery of the phosphor when it passes over a non-discharge area. Furthermore, the coating process may also dispense the phosphors on the bridge-type barrier rib members defining the non-discharge cells, which may then cause the phosphors to overflow into neighboring discharge cells. The overflow of phosphors results in the mixing of phosphor colors in the discharge cells, degrading the display quality of the PDP.

SUMMARY OF THE INVENTION

The present invention is therefore directed to a plasma display panel and a method of manufacturing the same, which substantially overcome one or more of the problems due to the limitations and disadvantages of the related art.

It is therefore a feature of an embodiment of the present invention to provide a plasma display panel in which the structure of barrier ribs is modified to be suitable for applying a phosphor layer effectively.

It is therefore another feature of an embodiment of the present invention to provide a plasma display panel having non-discharge cells defined by tapered bridge-type barrier rib members.

It is therefore yet another feature of an embodiment of the present invention to provide a method of manufacturing a plasma display panel that includes continuously dispensing phosphors.

At least one of the above and other features and advantages of the present invention may be realized by providing a plasma display panel including a substrate, and barrier ribs formed on the substrate and defining discharge cells and non-discharge cells, the barrier ribs including first, second and third barrier rib members, wherein the discharge cells are defined by the first and second barrier rib members, the second barrier rib members perpendicular to and intersecting the first barrier rib members, the non-discharge cells are defined by the second and third barrier rib members, wherein the third barrier rib members are located between columns of the discharge cells and are disposed parallel to the first barrier rib members, and a cross-sectional area of at least one third barrier rib member is greater at a bottom portion of the at least one third barrier rib member than at a top portion thereof.

A side wall of the at least one third barrier rib member may be inclined. Two side walls of the at least one third barrier rib member may be inclined. Two side walls of the at least one third barrier rib member may meet at a topmost portion of the at least one third barrier rib member. Two side walls of the at least one third barrier rib member may be joined at topmost portions of the side walls by a top region. The top region may be substantially flat. A width of the top region may be greater than about zero and less than about 10 μm. The third barrier rib members may be staggered relative to the first barrier rib members. The third barrier rib members may be centered between adjacent first barrier rib members. The plasma display panel may further include phosphor layers formed in the discharge cells and in the non-discharge cells. The plasma display panel may further include address electrodes formed on the substrate and extending in a direction parallel to the first barrier rib members, and another substrate having black stripes formed thereon and arranged adjacent to the substrate such that the barrier ribs are disposed between the two substrates, wherein the black stripes extend perpendicular to the address electrodes and are aligned with the non-discharge cells.

At least one of the above and other features and advantages of the present invention may also be realized by providing a method of manufacturing a plasma display panel, including providing a substrate, and forming barrier ribs on the substrate, wherein forming the barrier ribs may includes forming first barrier rib members extending in a first direction, forming second barrier rib members extending in a second direction substantially perpendicular to the first barrier rib members and intersecting the first barrier rib members to define discharge regions, wherein at least one non-discharge region is defined between two adjacent second barrier rib members, and forming third barrier rib members in the non-discharge region, the third barrier rib members extending in the first direction and offset from the first barrier rib members, wherein the third barrier rib members include at least one tapered side portion.

The second and third barrier rib members may define non-discharge cells, the non-discharge cells having at least one inclined wall defined by the tapered side portion. The third barrier rib members may be formed by sandblasting or photolithography. The method may further include applying at least one phosphor to the substrate, wherein applying the phosphor includes applying the phosphor in discharge regions and the at least one non-discharge region. Applying the phosphor may include continuously applying the phosphor with a dispenser. The dispenser may move in the first direction while applying the phosphor. The method may further include allowing the phosphor to flow down the tapered side portion. The method may further include attaching a second substrate to the substrate, such that the barrier ribs are disposed between the two substrates, after allowing the phosphor to flow down the tapered side portion. Applying the phosphor in the at least one non-discharge region may include applying the phosphor to a narrowest portion of the third barrier rib members.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
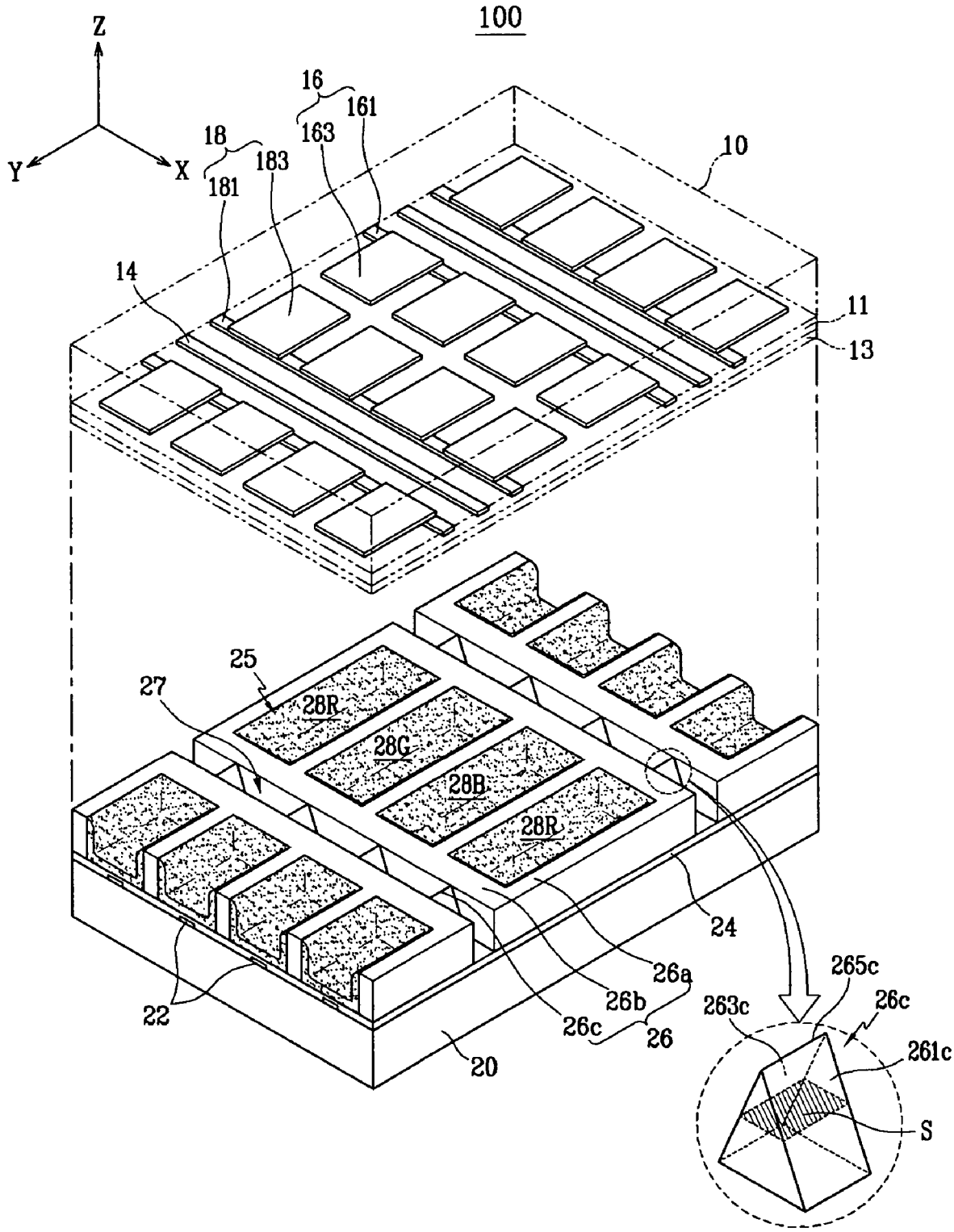
FIG. 1 illustrates a partial exploded perspective view of a plasma display panel according to a first embodiment of the present invention.

Korean Patent Application No. 10-2005-0029537, filed on Apr. 8, 2005, in the Korean Intellectual Property Office, and entitled: "Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

A plasma display panel (PDP), and a method of manufacturing the same, will be described in detail herein. The PDP according to the present invention may include a substrate having barrier ribs formed thereon, wherein at least one barrier rib member has a decreasing cross section, determined moving away from the substrate. That is, the at least one barrier rib member may be very narrow at the top, in order to allow phosphors applied thereto to flow easily off of the top. Thus, color mixing between discharge cells and non-discharge cells may be reduced or prevented, because the phosphors applied to the at least one barrier rib member flow down along the side walls thereof. That is, the applied phosphors do not stay on the top portion of the at least one barrier rib member and flow down easily so that color mixing between the phosphors does not happen.

In an embodiment, the phosphors staying on the at least one barrier rib member may be reduced by making the width of the top portion of the third barrier rib member greater than about zero and less than about 10.0 μm. The at least one barrier rib member may be staggered relative to adjacent discharge cells, e.g., centered relative thereto, to support the discharge cells and reduce or prevent shrinkage of the discharge cells or distortion of the barrier ribs during plastic working of the phosphors. The plasma display panel according to the present invention allows for continuous dispensing of phosphors thereon and may be suitable for mass production using a multi panel cutting process. The dispenser may efficiently apply the phosphors in the discharge cells because the dispenser may move continuously. The at least one barrier rib member may be formed easily by sandblasting or photolithography.

FIG. 1 illustrates a partial exploded perspective view of a plasma display panel according to a first embodiment of the present invention. Referring to FIG. 1, an example of a PDP 100 according to the first embodiment of the present invention includes a barrier rib structure defined by barrier ribs 26, which include first through third barrier rib members 26*a*-26*c*, suited to having phosphors applied thereto by a dispenser. FIG. 1 also includes an enlarged illustration of the third barrier rib member 26*c*, as indicated by the dashed circles.

For clarity of description and illustration, a first substrate 10 in FIG. 1 is represented by dashed lines in order to show display electrodes 16 and 18. Also shown by dashed lines are a dielectric layer 11 and a protective layer 13, which may be formed over the display electrodes 16 and 18 to protect them. Note however, that the illustrated structures 10, 11 and 13 are merely exemplary and are provided in order to provide a complete description of the PDP according to the present invention. Accordingly, these structures may be suitably varied and do not limit the scope of the present invention.

As shown in FIG. 1, the PDP 100 may include a first substrate 10 and a second substrate 20, which is spaced apart from the first substrate 10 by a predetermined distance and faces the first substrate 10. Discharge cells 25 may be formed between two substrates 10 and 20 and defined by the barrier ribs 26. A discharge gas (not shown) including, e.g., Ne, Xe, etc., fills the inside of the discharge cells 25. Each discharge cell may be driven by an independent discharge mechanism to emit visible light for producing an image, e.g., a color image.

On an inner surface of the first substrate 10, facing the second substrate 20, display electrodes, including scan electrodes 16 and sustain electrodes 18, and black stripes 14 may be formed in a direction substantially perpendicular to address electrodes 22, i.e., in the X direction, which is roughly from the upper left to the lower right in FIG. 1.

The electrodes 16 and 18 for each discharge cell may include of a pair of bus electrodes 161 and 181, respectively. The bus electrodes 161 and 181 may be formed in a striped pattern and may have a respective pair of enlarged electrodes 163 and 183 formed thereon. Each of the enlarged electrodes 163 and 183 may extend toward the inside of each discharge cell 25 from the bus electrodes 161 and 181. The enlarged electrodes 163 and 183 may face each other across the discharge cell 25 and may be separated from each other by a predetermined gap. Each of the enlarged electrodes 163 and 183 may be a transparent electrode made of, e.g., indium-tin oxide (ITO). Bus electrodes 161 and 181 may be, e.g., metallic electrodes. The overall structures of the scan electrodes 16 and the sustain electrodes 18 may be substantially the same.

The PDP 100 may include the address electrodes 22 formed in a Y-direction on an inner surface of the second substrate 20, i.e., formed from the lower left to the upper right in FIG. 1. A dielectric layer 24 may be formed on the entire inner surface of the second substrate 20 and may cover the address electrodes 22. The address electrodes 22 may be formed in a striped pattern, such that each address electrode is arranged in parallel to the neighboring address electrodes and separated therefrom by a predetermined gap.

The barrier ribs 26 may be formed on the dielectric layer 24 and may be arranged in a regular pattern, e.g., a matrix pattern. Phosphor layers 28R, 28G and 28B (red (R), green (G), and blue (B), respectively) may be formed on the dielectric layer 24 and on the side walls of the barrier ribs 26. In particular, the phosphor layers 28R, 28G and 28B may be disposed in discharge cells 25 defined by the first and second barrier rib members 26*a* and 26*b*. The phosphor layers 28R, 28G and 28B may also be disposed in non-discharge cells 27 defined by the second and third barrier rib members 26*b* and 26*c*, as will be discussed in greater detail below. The non-discharge cells 27 may be disposed below the black stripes 14.

In operation, a discharge cell 25 selected for light emission may be selected by applying an address voltage (Va) between the address electrode 22 and the scan electrode 16. Then, a plasma discharge takes place inside the selected discharge cell 25 by a sustain voltage (Vs) applied between the sustain electrode 18 and the scan electrode 16, and the plasma emits vacuum ultraviolet light that excites the phosphor layer disposed therein, e.g., one of 28R, 28G and 28B, to emit visible light for an image.

As shown in FIG. 1, the barrier ribs 26 are disposed between the first substrate 10 and the second substrate 20 and define the discharge cells 25 and non-discharge cells 27. First barrier rib members 26*a* extend in the Y-direction, i.e., parallel to the direction of the address electrodes. Second barrier rib members 26*b* may intersect and may be substantially perpendicular to the first barrier rib members 26*a*, e.g., intersecting at substantially right angles. The discharge cells 25 are defined by the intersections of the first barrier rib members 26*a* and the second barrier rib members 26*b*.

The non-discharge cells 27 may be defined between the discharge cells 25. In particular, the non-discharge cells 27 may be formed in columns, which run between columns of the discharge cells 25, along the X-direction. The non-discharge cells 27 are defined and divided from adjacent non-discharge cells 27 by the third barrier rib members 26*c*. The third barrier rib members 26*c* may be arranged substantially parallel to the first barrier rib members 26*a*.

While the third barrier rib members 26*c* may be substantially parallel to the first barrier rib members 26*a*, they may be offset therefrom. That is, the third barrier rib members 26*c* may be staggered relative to the first barrier rib members 26*a*, such that the third barrier rib members 26*c* are disposed between adjacent first barrier rib members 26*a*. For example, the third barrier rib members 26*c* may be placed at about the middle points between two neighboring first barrier rib members 26*a*. The third barrier rib members 26*c* may support the discharge cells 25 and, therefore, may prevent shrinkage of the discharge cells 25 or the distortion of the barrier ribs during the plastic working.

FIG. 1 also includes an enlarged illustration of one third barrier rib member 26*c*, as indicated by the dashed circles. Referring to the enlarged illustration, the transverse cross-sectional area (S) of the third barrier rib member 26*c* may decrease in the direction of the first substrate 10. That is, the third barrier rib member 26*c* may gradually taper, such that the transverse cross-sectional area (S) becomes less as it gets farther from the second substrate 20 and closer to the first substrate 10.

For example, the side walls 261*c* and 263*c* of the third barrier rib member 26*c* may be inclined so that the transverse cross-sectional area (S) of the third barrier rib member 26*c* decreases gradually as it approaches the first substrate 10. The third barrier rib member 26*c* may be formed such that side walls 261*c* and 263*c* are inclined so as to meet with each other directly at a top portion 265*c* of the third barrier rib member 26*c*. The third barrier rib member 26*c* may have a substantially triangular shape, as shown in FIG. 1.

During the manufacture of the PDP 100, phosphors 28R, 28G and 28B may each be individually applied to the second substrate 20 by continuously dispensing individual phosphors while moving a dispenser along rows of corresponding discharge cells 25, i.e., in the Y direction. As the phosphors 28R, 28G and 28B may be continuously dispensed, they may be dispensed not only within the discharge cells 25, but also across the third barrier rib members 26*c* disposed between adjacent discharge cells 25. In this case, the applied phosphors, which may be on the top of the third barrier rib member 26*c*, can flow down along the inclined side walls 261*c* and 263*c* of the third barrier rib member 26*c*. Thus, as the top portion 265*c* of the barrier rib member 26*c* can shed the dispensed phosphor, the phosphor is less likely to spill into adjacent discharge cells 25, which may contain a different color phosphor. Thus, a PDP according to the present invention may exhibit less color mixing than conventional PDPs.

Figure 2:
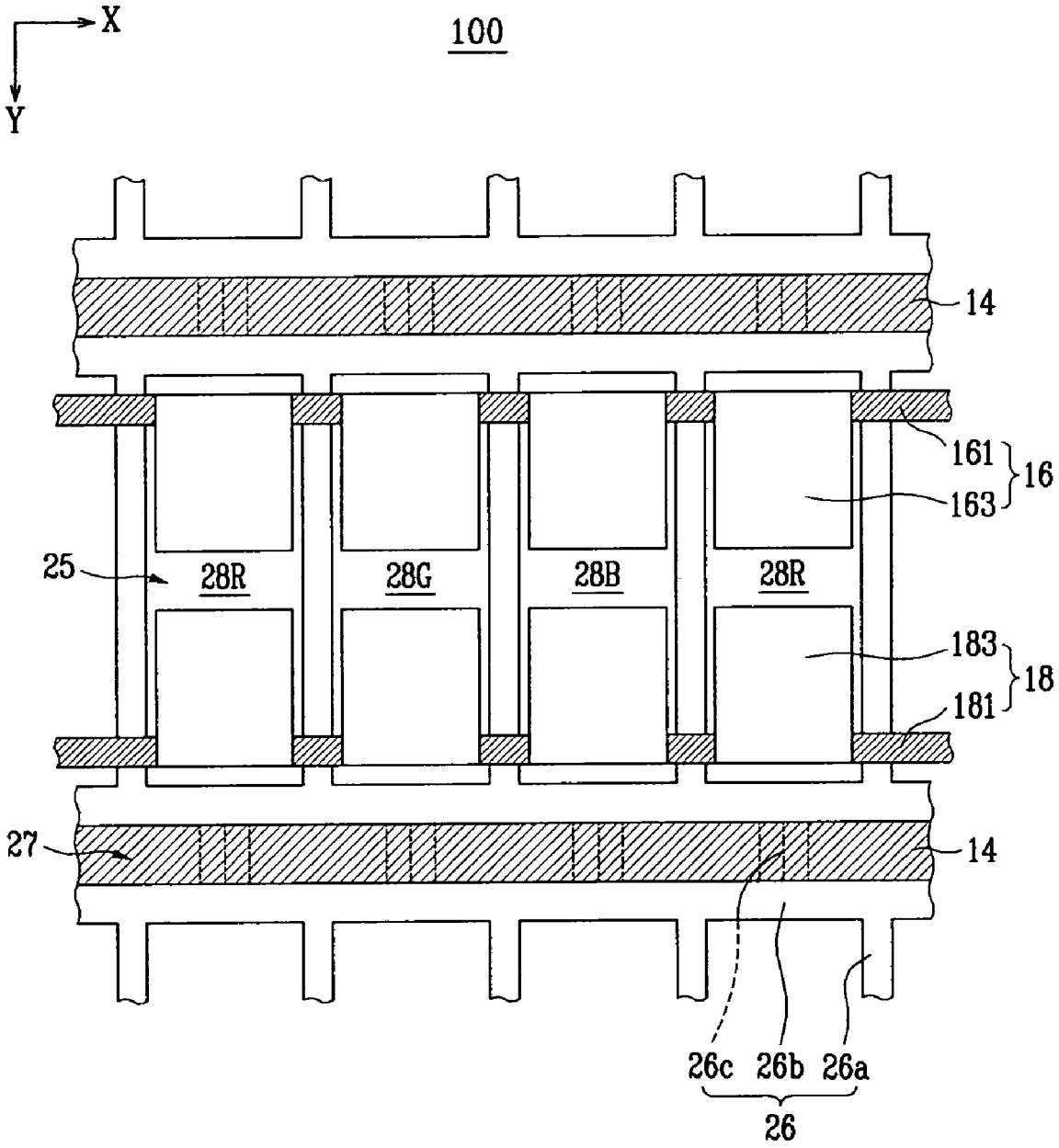
FIG. 2 illustrates a plan view of the plasma display panel of FIG. 1.

FIG. 2 illustrates a plan view of the plasma display panel of FIG. 1 from the perspective of the Z-direction. Referring to FIG. 2, the display electrodes 16 and 18 may be located over the discharge cells 25 and black stripes 14 may be located over the non-discharge cells 27. Bright room contrast of the PDP may be improved by forming the black stripes 14 so as to completely cover the non-discharge cells 27. Thus, displayed images may be clearer.

Figure 3:
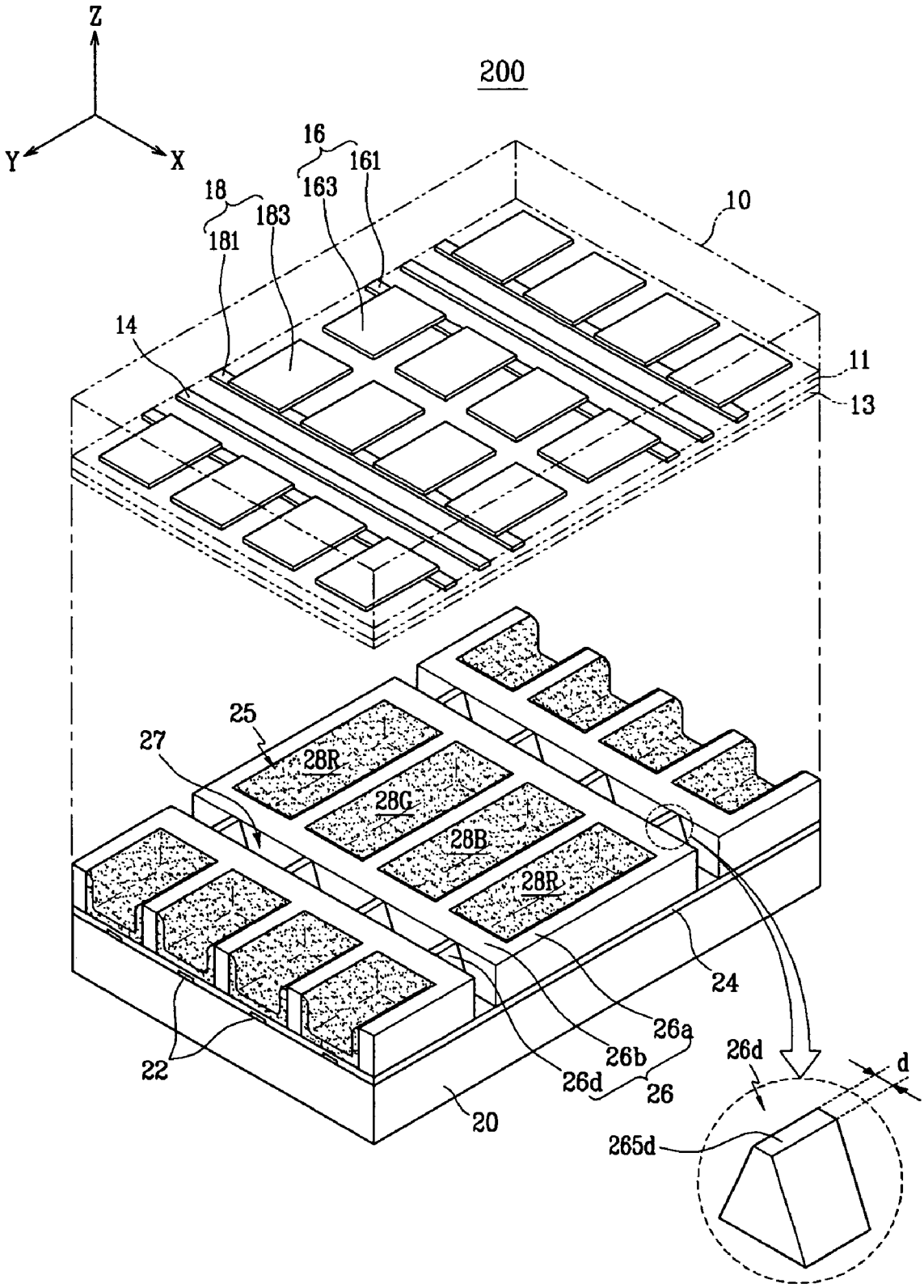
FIG. 3 illustrates a partial exploded perspective view of a plasma display panel according to a second embodiment of the present invention.

FIG. 3 illustrates a partial exploded perspective view of a PDP 200 according to a second embodiment of the present invention, wherein a third barrier rib member 26*d* is different in shape from the third barrier rib member 26*c* of the first embodiment. Other features of the PDP 200 may be substantially similar to those described above with respect to the PDP 100. Therefore, in order to avoid repetition, a detailed explanation of the other features will be omitted from the following detailed description of PDP 200.

Referring to FIG. 3, the third barrier rib member 26*d* may have a substantially trapezoidal or truncated shape. That is, referring to the enlarged illustration of the third barrier rib member 26*d* indicated by the dashed circles, the third barrier rib member 26*d* may have a top portion 265*d*, wherein the top portion 265*d* has a width (d). The width (d) is defined perpendicular to the direction of the address electrodes 22. That is, the width (d) is measured in the X direction in FIG. 3.

The width (d) may be greater than about zero μm and less than about 10 μm. If the width (d) is allowed to become larger than about 10 μm, color mixing is more likely to happen because phosphors dispensed on the top portion 265*d* may remain there.

Figure 4:
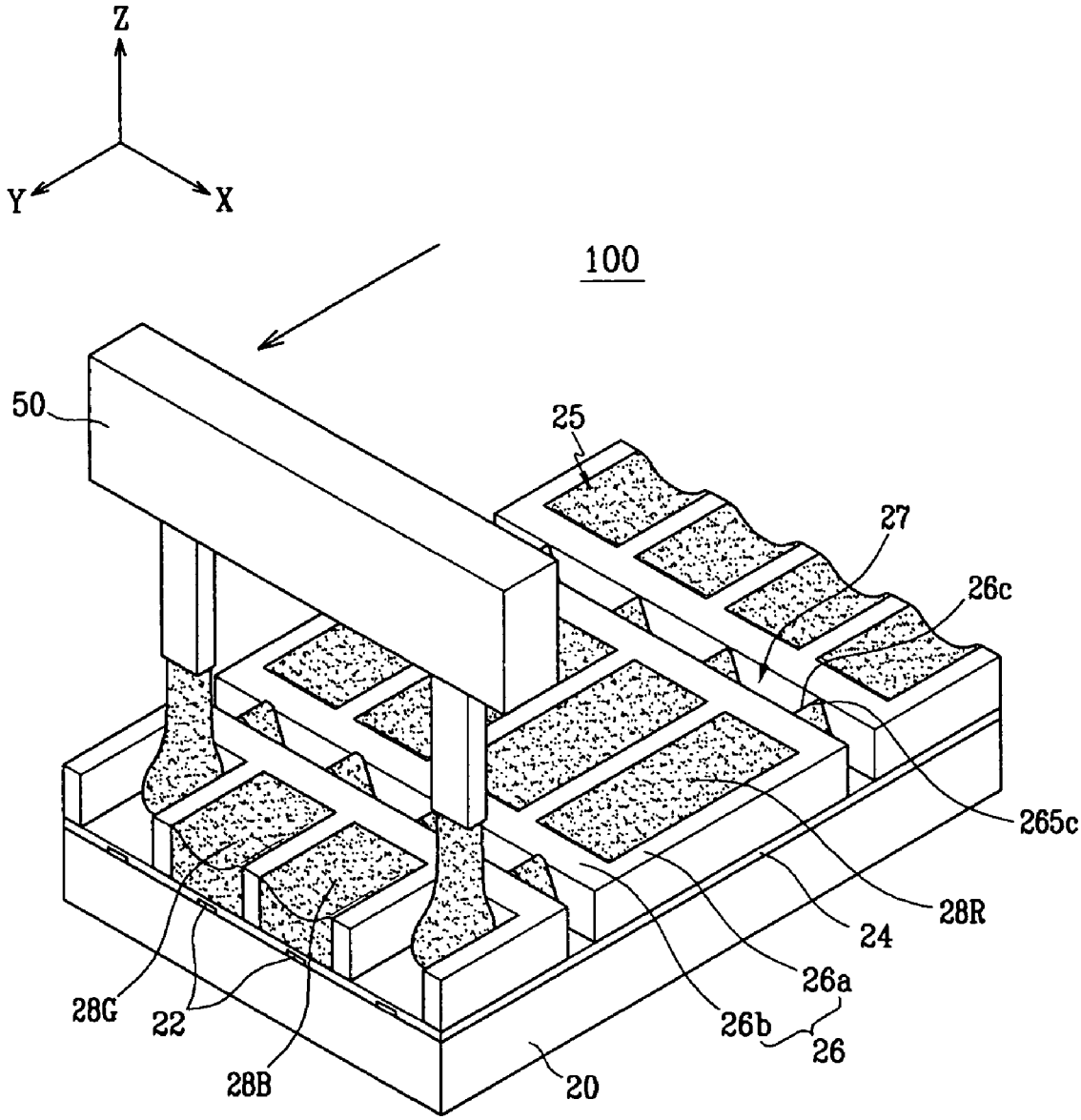
FIG. 4 illustrates a schematic view of a stage in a process of manufacturing a plasma display panel according to the present invention.

FIG. 4 illustrates a schematic view of a stage in a process of manufacturing a plasma display panel according to the present invention. Referring to FIG. 4, the second substrate 20 may have the barrier ribs 26 formed thereon. In particular, the first and second barrier rib members 26*a* and 26*b* may define the discharge cells 25. Further, the non-discharge regions may be defined between adjacent second barrier rib members 26*b*.

In the non-discharge regions, the third barrier rib members 26*c* may be formed so as to intersect the second barrier rib members 26*b*. The third barrier rib members 26*c* may be offset, or staggered, relative to the first barrier rib members 26*a*. The non-discharge cells 27 may be defined by the second and third barrier rib members 26*b* and 26*c*.

The third barrier rib members 26 may have tapered side portions, such the cross-sectional area of the third barrier rib member 26*c* decreases moving away from the second substrate 20. The tapered side portions of the third barrier rib members 26*c* may define inclined side walls of the non-discharge cells 27. The third barrier ribs members 26*c* may be formed simply by sandblasting or photolithography After forming the barrier ribs 26, the phosphor layers 28R, 28G and 28B may be formed by plastic working after applying phosphor materials to the spaces between the barrier ribs 26 with a dispenser 50. A single phosphor color may be applied at any given time, in order to reduce the chances of color mixing. FIG. 4 shows applying red phosphor material as an example, although, of course, the other phosphors may be similarly applied.

In manufacturing the PDP 100, the red phosphor material may be applied along the Y-direction, i.e., the extending direction of the address electrodes 22, and dispensed into the discharge cells 25 to form the red phosphor layer 28R. The arrow in FIG. 4 shows the moving direction of the dispenser 50. The red phosphor material may contain moisture and may be applied so as to fill the inside of the respective discharge cells 25. The phosphor layer 28R may be formed by continuously applying the red phosphor material with the dispenser 50. Thus, the red phosphor material may be applied not only in the respective discharge cells 25, but also in the non-discharge cells 27 and on the third barrier rib members 26*c*, because the dispenser may continuously apply the red phosphor material while passing over the non-discharge cells 27 between the discharge cells 25. Since the moisture in the phosphors evaporates during the plastic working, the applied red phosphor material forms the red phosphor layer 28R, which is fixed to the barrier ribs 26.

The shape of the third barrier rib members 26*c* may be modified in a manner that allows the red phosphor material applied thereon to flow down to the bottom of the adjacent non-discharge cells 27. That is, each third barrier rib member 26*c* may have a narrowest portion 265*c*, i.e., the uppermost point of the third barrier rib member 26*c*, on which the red phosphor material does not remain. The applied red phosphor material in the non-discharge cells may flow downward, to the bottom of the non-discharge cells 27, due to the shape of the third barrier rib members 26*c*. Thus, by allowing some time to elapse after the red phosphor material application, the top portion 265*c* of the third barrier rib member 26*c* may have no red phosphor material thereon, and may thus be exposed.

The width of the top portion 265*c* of the third barrier rib member 26*c* may be essentially zero, as shown in FIG. 1, or may be somewhat larger, on the order of several micrometers, as illustrated by element 265*d* of the third barrier rib member 26*d* in FIG. 3. Therefore, due to the narrow width of the top portions 265*c*/265*d*, it is difficult or impossible for the red phosphor material to remain on the top portions 265*c*/265*d* of the third barrier rib member 26*c*/26*d*. Thus, in the manufacture of a PDP according to the present invention, the likelihood of an applied phosphor material mixing with the phosphors layers 28 in the adjacent discharge cells 25. Further, it is possible to make the phosphors 28R, 28G and 28B more or less likely to flow down by adjusting the width of the narrow portion, i.e., by the simple adjustment of the width (d) of the narrow portion 265*d* of the third barrier rib member 26*d*, illustrated in FIG. 3, using sandblasting or photolithography. Further, the overall shape of the third barrier rib members 26*c*/26*d* may be altered by these same processes. That is, one or both sides may be inclined, the incline may be linear, stepped, convex, or concave, etc.

After the phosphor layers 28R, 28G and 28B have been applied to the second substrate 20, the first and second substrates 10 and 20 may be aligned and sealed together with a discharge gas filling the discharge cells 25. The third barrier ribs members 26*c* may be disposed corresponding with the black stripes 14, e.g., directly below them.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel comprising:

a substrate; and barrier ribs formed on the substrate and defining discharge cells and non-discharge cells, the barrier ribs including first, second and third barrier rib members, wherein:

the discharge cells are defined by the first and second barrier rib members, the second barrier rib members perpendicular to and intersecting the first barrier rib members, the non-discharge cells are defined by the second and third barrier rib members, wherein the third barrier rib members are located between columns of the discharge cells and are disposed parallel to the first barrier rib members, and a cross-sectional area of at least one third barrier rib member is greater at a bottom portion of the at least one third barrier rib member than at a top portion thereof.

2. The plasma display panel as claimed in claim 1, wherein a side wall of the at least one third barrier rib member is inclined.

3. The plasma display panel as claimed in claim 2, wherein two side walls of the at least one third barrier rib member are inclined.

4. The plasma display panel as claimed in claim 1, wherein two side walls of the at least one third barrier rib member meet at a topmost portion of the at least one third barrier rib member.

5. The plasma display panel as claimed in claim 1, wherein two side walls of the at least one third barrier rib member are joined at topmost portions of the side walls by a top region.

6. The plasma display panel as claimed in claim 5, wherein the top region is substantially flat.

7. The plasma display panel as claimed in claim 5, wherein a width of the top region is greater than about zero and less than about 10 μm.

8. The plasma display panel as claimed in claim 1, wherein the third barrier rib members are staggered relative to the first barrier rib members.

9. The plasma display panel as claimed in claim 8, wherein the third barrier rib members are centered between adjacent first barrier rib members.

10. The plasma display panel as claimed in claim 1, further comprising phosphor layers formed in the discharge cells.

11. The plasma display panel as claimed in claim 1, further comprising:

address electrodes formed on the substrate and extending in a direction parallel to the first barrier rib members; and another substrate having black stripes formed thereon and arranged adjacent to the substrate such that the barrier ribs are disposed between the two substrates, wherein the black stripes extend perpendicular to the address electrodes and are aligned with the non-discharge cells.

12. A method of manufacturing a plasma display panel, comprising:

providing a substrate; and forming barrier ribs on the substrate, wherein forming the barrier ribs includes:

forming first barrier rib members extending in a first direction;

forming second barrier rib members extending in a second direction substantially perpendicular to the first barrier rib members and. intersecting the first barrier rib members to define discharge regions, wherein at least one non-discharge region is defined between two adjacent second barrier rib members; and forming third barrier rib members in the non-discharge region, the third barrier rib members extending in the first direction and offset from the first barrier rib members, wherein the third barrier rib members include at least one tapered side portion.

13. The method as claimed in claim 12, wherein the second and third barrier rib members define non-discharge cells, the non-discharge cells having at least one inclined wall defined by the tapered side portion.

14. The method as claimed in claim 12, wherein the third barrier rib members are formed by sandblasting or photolithography.

15. The method as claimed in claim 12, further comprising applying at least one phosphor to the substrate, wherein applying the phosphor includes applying the phosphor in discharge regions and the at least one non-discharge region.

16. The method as claimed in claim 15, wherein applying the phosphor includes continuously applying the phosphor with a dispenser.

17. The method as claimed in claim 16, wherein the dispenser moves in the first direction while applying the phosphor.

18. The method as claimed in claim 15, further comprising allowing the phosphor to flow down the tapered side portion.

19. The method as claimed in claim 18, further comprising attaching a second substrate to the substrate, such that the barrier ribs are disposed between the two substrates, after allowing the phosphor to flow down the tapered side portion.

20. The method as claimed in claim 15, wherein applying the phosphor in the at least one non-discharge region includes applying the phosphor to a narrowest portion of the third barrier rib members.

* * * * *